US007503394B2

(12) United States Patent
Bouligny

(10) Patent No.: US 7,503,394 B2
(45) Date of Patent: Mar. 17, 2009

(54) SYSTEM FOR RUNNING OILFIELD TUBULARS INTO WELLBORES AND METHOD FOR USING SAME

(75) Inventor: Vernon J. Bouligny, New Iberia, LA (US)

(73) Assignee: Frank's Casing & Rental Tools, Inc., Lafayette, LA (US)

( * ) Notice: Subject to any disclaimer, the term of this patent is extended or adjusted under 35 U.S.C. 154(b) by 23 days.

(21) Appl. No.: 11/147,525

(22) Filed: Jun. 8, 2005

(65) Prior Publication Data

US 2006/0278400 A1 Dec. 14, 2006

(51) Int. Cl.
*E21B 19/20* (2006.01)
*E21B 19/15* (2006.01)

(52) U.S. Cl. ..... 166/380; 166/77.51; 166/77.53; 166/85.1; 414/22.54

(58) Field of Classification Search ..... 175/52, 175/85; 166/380, 381, 77.51–77.53, 85.1; 414/22.54

See application file for complete search history.

(56) References Cited

U.S. PATENT DOCUMENTS 3,158,212 A * 11/1964 Fanshawe et al. ..... 175/85
3,194,313 A * 7/1965 Fanshawe ..... 166/77.53
4,605,077 A * 8/1986 Boyadjieff ..... 175/85
6,854,520 B1 * 2/2005 Robichaux ..... 166/380

FOREIGN PATENT DOCUMENTS

WO WO 0133036 A2 * 5/2001

* cited by examiner

*Primary Examiner*—Giovanna C Wright
(74) *Attorney, Agent, or Firm*—Matthews, Lawson & Bowick, PLLC

(57) ABSTRACT

A four-cornered, open frame, connected either to a top drive or to a traveling block, has an elevator at its lower end used to support the weight of the tubular string, and has a mud tool, a stabber, a guide, a spinner, a tong, a stabbing guide and a backup tong carried by the frame. A manipulator arm picks up a horizontal tubular, manipulates the tubular to vertical, and moves the tubular into the interior of the frame, allowing the tubular to be made up in the string while the string is being lowered into the wellbore.

15 Claims, 6 Drawing Sheets

SYSTEM FOR RUNNING OILFIELD TUBULARS INTO WELLBORES AND METHOD FOR USING SAME

FIELD OF THE INVENTION

This invention relates, generally, to methods and systems for attaching single joints of casing, tubing and other oilfield tubulars together, while lowering the string of tubulars into a wellbore, and more particularly, to methods and systems using a top drive apparatus for running oilfield tubulars into wellbores.

DESCRIPTION OF RELATED ART

With the evolution of top drive assemblies used in running oilfield tubulars into wellbores, recently developed top drives have been equipped with adaptors to grip casing, drill pipe, production tubing and other tubulars for lifting, lowering and rotating the tubular string in the wellbores, and have also included apparatus for torquing such joints together. Such prior art systems can generally be described as attaching a tubular joint into the tubular string, as the tubular string is being held by a spider at the drill floor level and using tongs on the drill floor to screw the joint into the held tubular string, or alternatively, as attaching a tubular joint into the tubular string while the string is being held in the spider at the drill floor and using the top drive to screw the tubular joint into the held string, or alternatively, as attaching a double or triple stand of tubulars using either of the above methods where the double or triple stands are assembled at a different location.

DETAILED DESCRIPTION OF THE PREFERRED EMBODIMENT

Figure 1A:
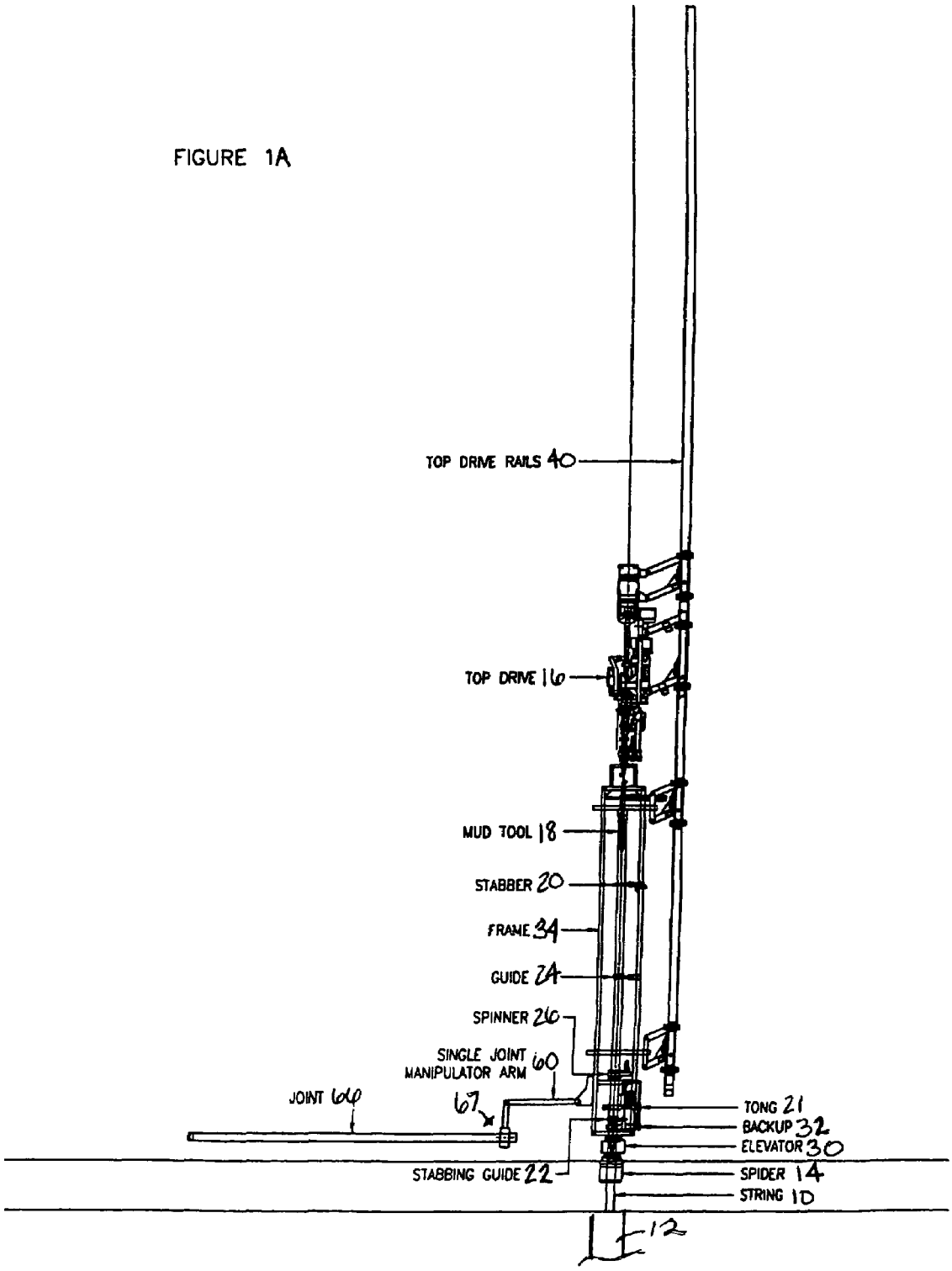
FIG. 1A is an elevated view of the system according to the invention, illustrating a first joint of tubular being in the initial phase of being picked up while a second joint of tubular is in the final stage of being made up with the tubular string.

Referring now to FIG. 1A, there is illustrated, in an elevated view, the system according to the invention, in which a string 10 of oilfield tubulars, for example, steel casing, is being run into an earth wellbore 12. The conventional, flush-mounted spider 14, can be used to grip the string 10 when needed. FIG. 1A also illustrates a conventional top drive assembly 16, a mud tool 18, which may consist of a fill-up and circulation tool, such as is described in U.S. Pat. No. 6,595,288, assigned to Frank's International, Inc., a stabber 20, such as is described in U.S. Pat. No. 6,921,386, assigned to Frank's Casing Crew and Rental Tools, Inc., a conventional spinner 26, such as illustrated in U.S. Pat. No. 6,634,259, assigned to Frank's International, Inc., a conventional pipe tong 21, an elevator 30, such as is described in U.S. Pat. No. 6,568,479, assigned to Frank's Casing Crew and Rental Tools, Inc., and a conventional backup tong 32. A frame 34 used with the invention, is illustrated in greater detail in FIG. 1B.

Figure 1B:
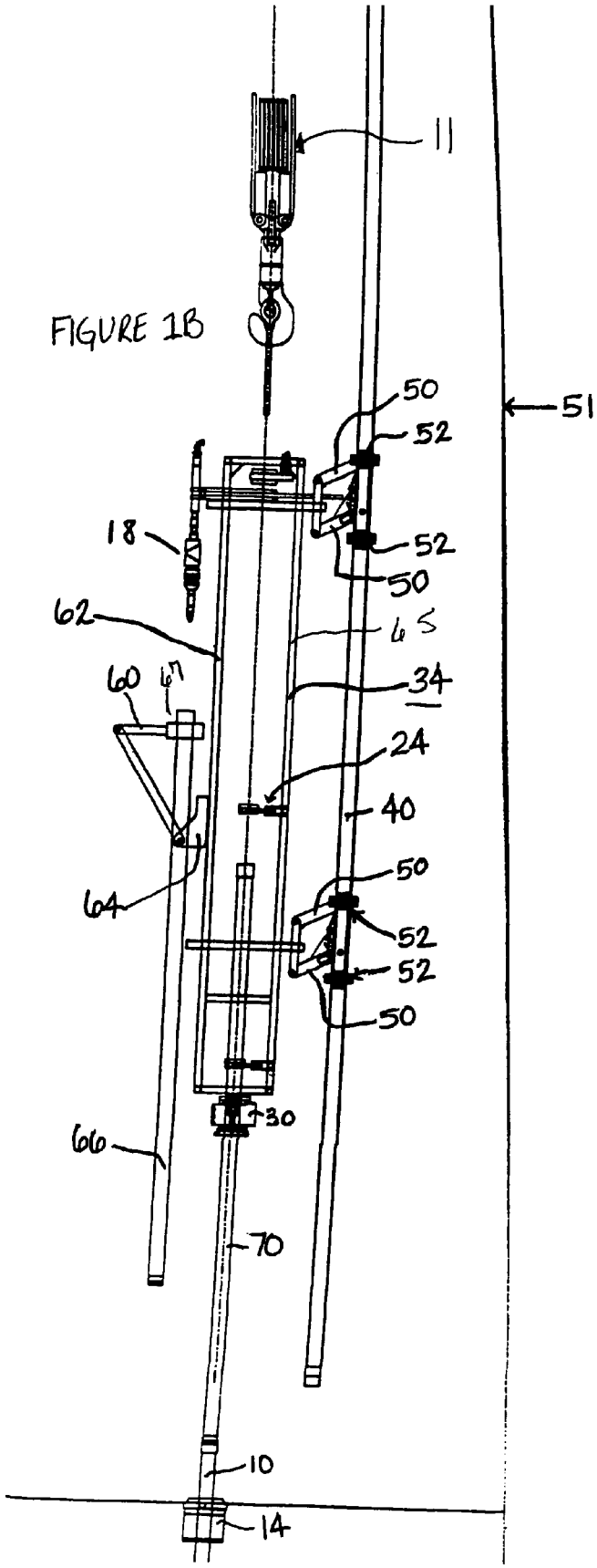
FIG. 1B is an elevated view of the system according to the invention illustrating in greater detail the frame illustrated in FIG. 1A, and the first joint of tubular being moved up to the upper portion of the frame.

Referring further to FIGS. 1A and 1B, the top drive rails 40 are situated on the oilfield derrick 51 (illustrated to allow the frame 34 to move up and down the rail or rails 40 using a plurality of arms 50 and a plurality of rollers 52, which cause such movement of the frame 34 up or down to be vertically aligned with the vertical alignment of the rail or rails 40.

A single joint manipulator arm 60 is pivotable connected to a first side member 62 of the frame 34 using a rolling or sliding member 64 (FIG. 1B) to allow a single joint 66 of oilfield tubular to be raised from the horizontal mode, illustrated in FIG. 1A, to the vertical mode illustrated in FIG. 1B. Alternatively, the gripping head 67 can rotate about its center, which coincides with the center of the joint 66, to enable the tubular joint 66 to move from the horizontal (FIG. 1A) to the vertical (FIG. 1B). By causing the rolling or sliding member 64 to move upwardly, either by its own motor (not illustrated) or by any conventional hoisting apparatus, the single joint 66 is moved upwardly towards the mud tool 18.

FIG. 1B illustrates the traveling block 11 which can be used as an alternative embodiment to that of FIG. 1A having the top drive 16.

In the operation of the system illustrated in FIG. 1A, the load of the tubular string 10 is first transferred to the spider 14 after the joint 70 has been added to the string 10 and the mud tool 18 has finished its filling operation. At this point in time, the elevator 30 has opened its slips, the stabber 20 has opened, the guide 24 has opened, the tong 21 jaws are retracted, the backup 32 jaws have been opened and the manipulator arm 60 has gripped the next joint 66 to be installed in the string 10.

The frame 34 is then lifted and the stabber 20 is pivoted up and the mud tool 18 is extracted from the string 10. As the mud tool 18 clears the upper end of the string 10, the mud tool 18 is positioned outboard of the frame 34 in a path directly in line with the upwardly moving joint 66 as illustrated in FIG. 1B.

Figure 2:
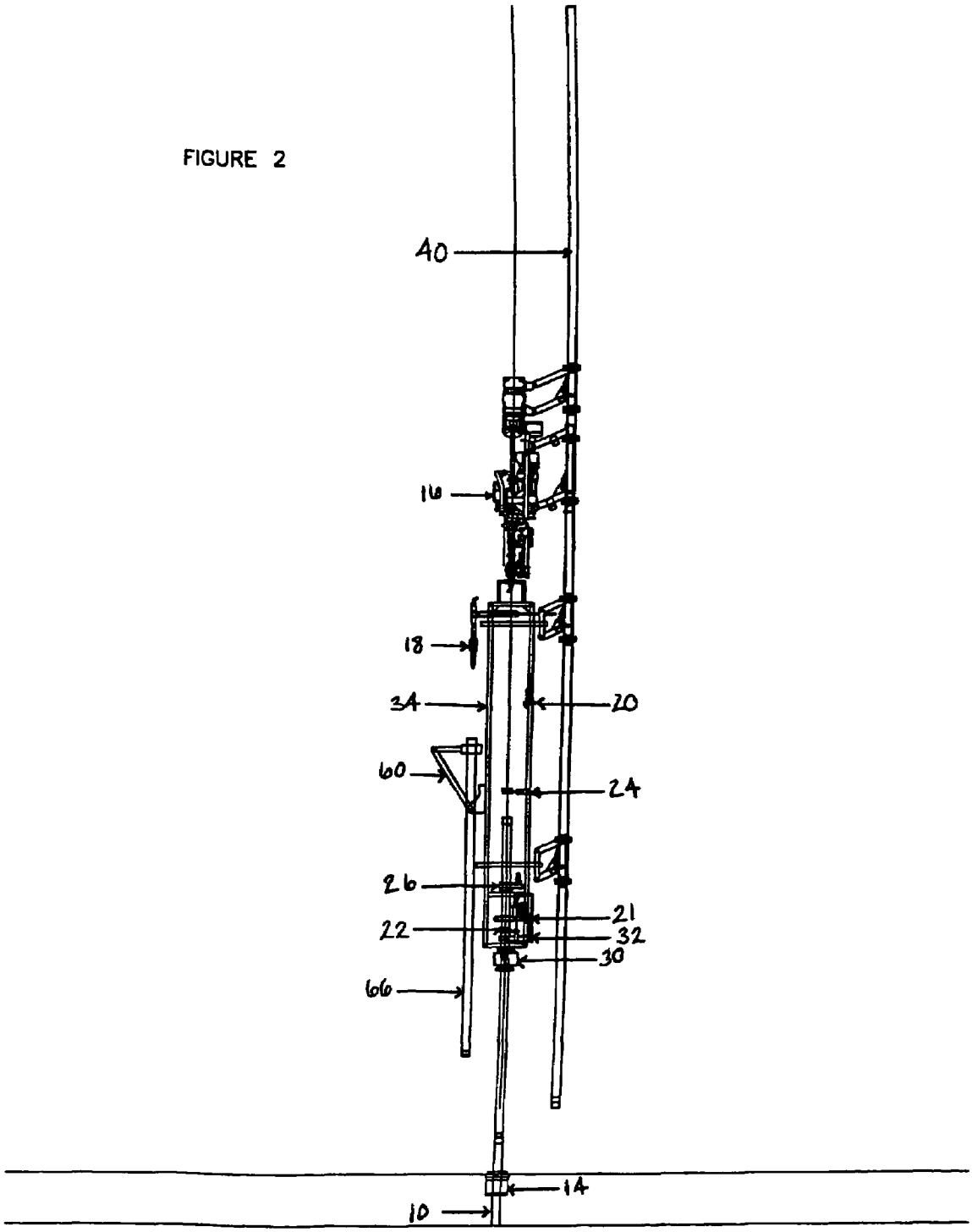
FIG. 2 is an elevated view of the system according to the invention, illustrating the first joint illustrated in FIG. 1A, while the frame of the system according to the invention is being lifted to grab the tubular string with the elevator.

Referring now to FIG. 2, the frame 34 is positioned such that the upper end of the tubular string 10 is located to allow the stabbing guide to be installed properly. At this point in time, the joint 66 is ready to be moved laterally and thus be located inside the frame 34. If desired, as illustrated in FIG. 1B, the mud tool 18 can be installed within the top of the joint 66 before the joint 66 is moved within the frame 34.

Figure 1C:
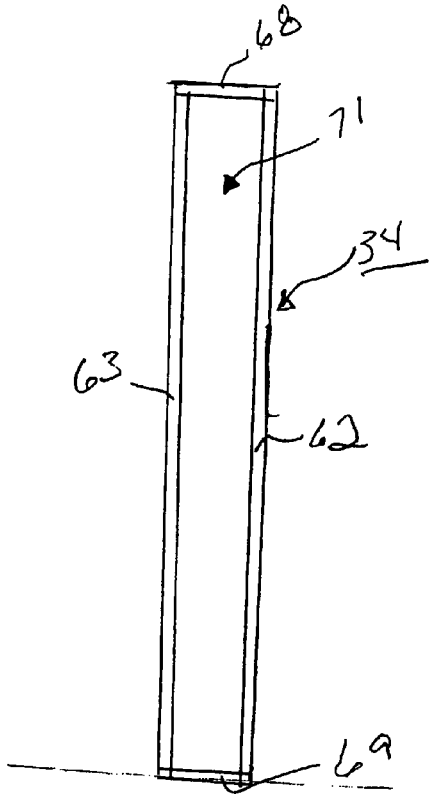
FIG. 1C is a second elevated view of the frame illustrated in FIG. 1B.
Figure 4:
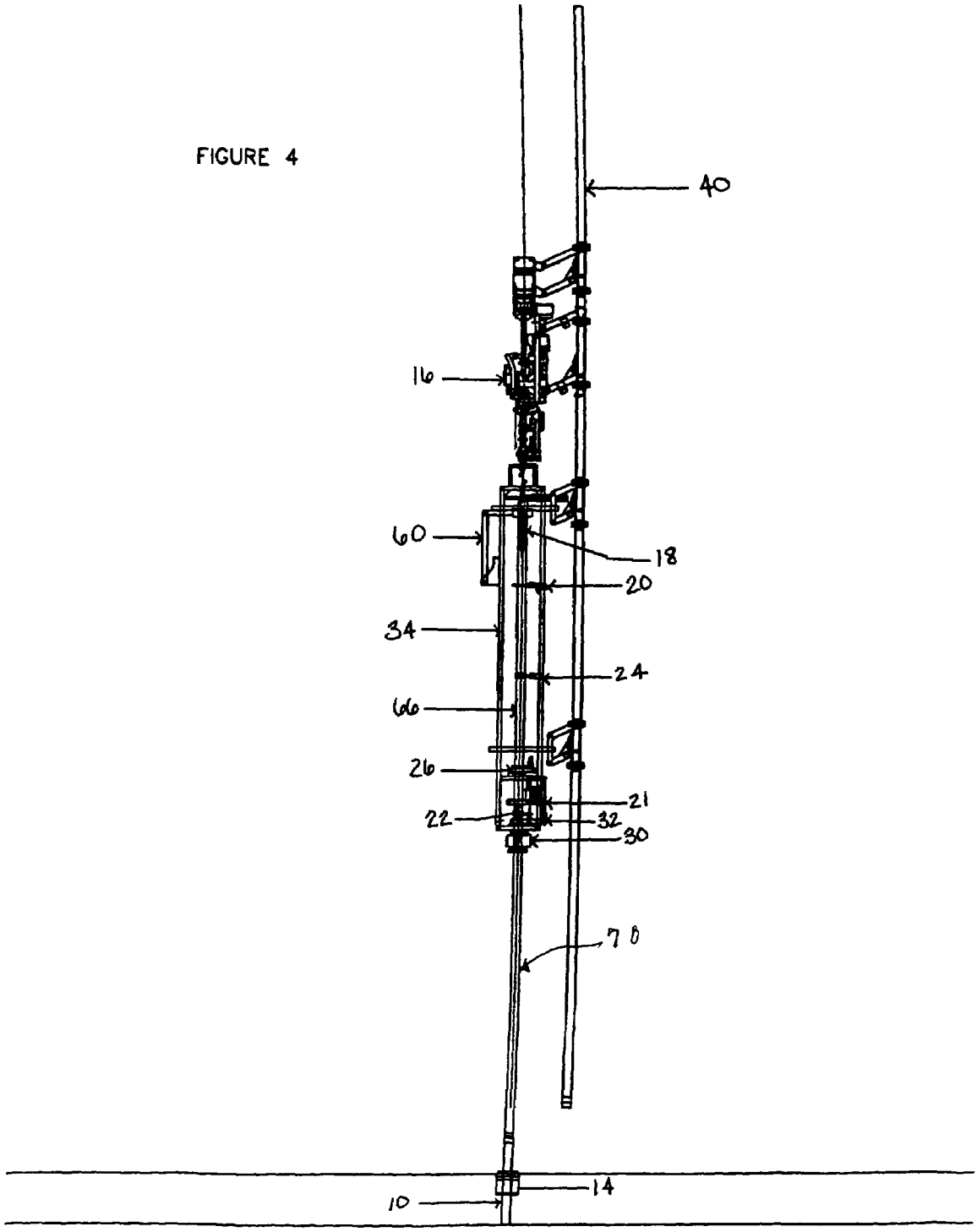
FIG. 4 is an elevated view of the system according to the invention, illustrating the tubular string being gripped by the elevator while the first tubular joint is positioned within the frame.

Referring now to FIGS. 1C and 4, the slips on the elevator 30 are set and the joint 66 is moved laterally to be within the frame 34. For such lateral movement to occur, the frame 34 has to have a vertical window 71 at least slightly longer than the length of the joint 66, and wide enough to allow the manipulator arm to rotate and move the joint 66 to a location within the frame 34.

Referring now to FIG. 1C, there is illustrated a view of the frame 34 oriented 90 degrees from the view illustrated in FIG. 1B. In FIG. 1C, the frame 34 includes the side member 62, also illustrated in FIG. 1B, and a second side member 63. The frame 34, as illustrated, has four side members 62, 63, 65 and a fourth side member which is hidden in the view of FIG. 1C, but lies behind said member 63 just as side member 65 lies behind side member 62.

It should be appreciated that support members can be used between the side members 62 and 65, and between the side members 63 and other, invisible side member, but the window 71 illustrated in FIG. 1C between the side members 62 and 63 must be left open, or as a minimum, be easily opened to allow the next joint, such as the joint 66 to be moved laterally to be within the frame 34.

In theory, at least, instead of moving the next joint 66 laterally into the frame 34, the joint 66 could be raised high enough to be moved in over the top end of the frame 34 and then into the interior of the frame 34, or like that of a derrick, with the top of the derrick closed off and the joint 66 moved in through the bottom of the frame 34. Once the joint 66 is within the interior of the frame 34, the operation continues essentially as described herein based upon the joint being moved laterally through the window 71. The window 71 between the side members 62 and 63 is long enough, as measured between the cross members 68 and 69 to accommodate the length of the joint 66, and wide enough to allow the manipulator arm 60 to rotate and move the joint 66 within the frame 34.

Figure 5:
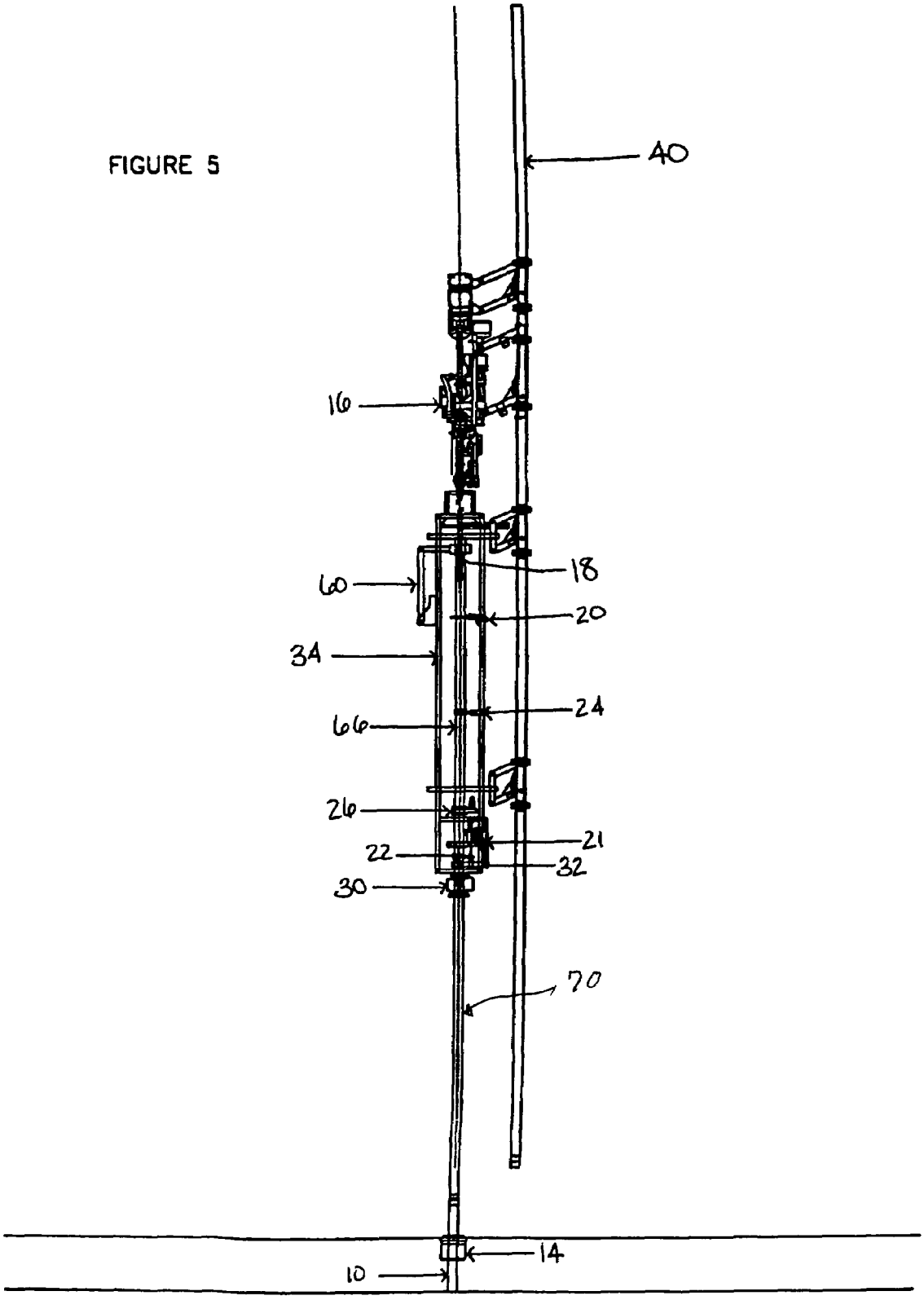
FIG. 5 is an elevated view of the system according to the invention, illustrating the tubular string being lifted while the first tubular joint is being stabbed into the tubular string.

The stabber guide 22 closes on joint 70, and guide 24, stabber 20 are closed around the joint 66. The driller then moves the frame 34 upward slightly as shown in FIG. 5 and releases the slips in the spider 14. Immediately thereafter, the manipulator arm 60 lowers the joint 66 into the stabbing guide 22 and into the upper end of the tubular string 10. As the next step the stabbing guide will open, the manipulator arm 60 will release, the backup tong will close and the spinner 26 grips and rotates the joint 66 while the driller lowers the string 10, the spinner 26 stops and manipulator arm 60 will lower, the mud tool 18 will activate and the tong 21 finishes the make-up of the joint 66 to the string 10. The process is then repeated to attached the next joint to the string 10.

Sometimes it is necessary to rotate and reciprocate the string while circulating fluids in order to facilitate installation of the string into the well bore. With the mud tool installed and the elevator gripped on the string, it is apparent that one can reciprocate and circulate. In order to rotate, the frame 34 must be connected to the top drive's quill and a swivel added to supply hydraulic, air, and electrical services.

It should be appreciated that the system according to the present invention in its preferred embodiment, comprises a frame, a manipulator arm, a mud tool, a stabber, a guide, a spinner, a tong, a stabbing guide, a backup tong, an elevator, and optionally comprises a pipe doper and a mud bucket. It should also be appreciated that the frame supplies the mounts for most, if not all of the other equipment. The frame can be attached to the top drive, if available, or to a traveling block. To attach the frame to the traveling block, either a hook adaptor or bails must be used. To attach the frame to a top drive, it can be screwed to a drive quill. When using either the top drive or traveling block there are two methods of attaching the bails. The first method entails connecting the bails to the top of the frame 34 and the elevator 30 to the bottom of the frame 34, in which the load path of the string is through the frame. The second method connects the bails directly to the elevator and the frame, while attached to the bails, is not in the direct load path of the string. When using a top drive, the frame may be connected by bails, to support the axial load, and to the quill, to provide rotation, at the same time. The frame is also attached to the top drive rails to provide a reaction when lifting the next joint to be installed and for rotational stability.

The manipulator arm mounts on the side of the frame and is capable of traversing the entire length of the frame 34. It uses a gripping head to latch onto the joint and can articulate the joint between the horizontal and the vertical positions.

The mud tool is preferably a conventional tool. It will be connected to the mud supply via the top drive quill or swivel. It is mounted on the top of the frame and can be moved perpendicular to the length of the frame to facilitate installation.

The stabber, guide, spinner, tong, stabbing guide, backup, elevator, pipe doper and mud bucket are all conventional equipment. The stabber and guide will be located closer to the middle of the frame while the rest of the equipment is located on or near to the bottom of the frame.

It should be appreciated that the present invention is not limited to running steel casing into earth wellbores, but can also be used to run a string of other oilfield tubulars, such as, drill pipe, production tubing and the like. Moreover, while the preferred embodiment has designated particular types of equipment to be used in the process, those skilled in this art will immediately recognize that other types of conventional elevators, stabbers, stabber guides, guides, tongs, spinners, backup tongs, mud tools, manipulator arms and top drive assemblies, or their respective equivalents, can also be used in practicing the invention.

It should also be appreciated that the frame for practicing the invention can take other forms, for example, such that the frame, which is used in alternative embodiments, if desired, be either partially or totally enclosed. It should also be appreciated that all of the equipment used herein can be attached to the bails without using a frame such as frame 34.

Although the preferred embodiment of the invention contemplates apparatus and methods for adding a single joint of tubular into a string of tubulars, while the string is being moved into and/or towards a wellbore, the invention also contemplates the use of the invention to add two or more joints which have already been made-up, into a string of tubulars as the string is being lowered into and/or towards a wellbore.

Figure 3:
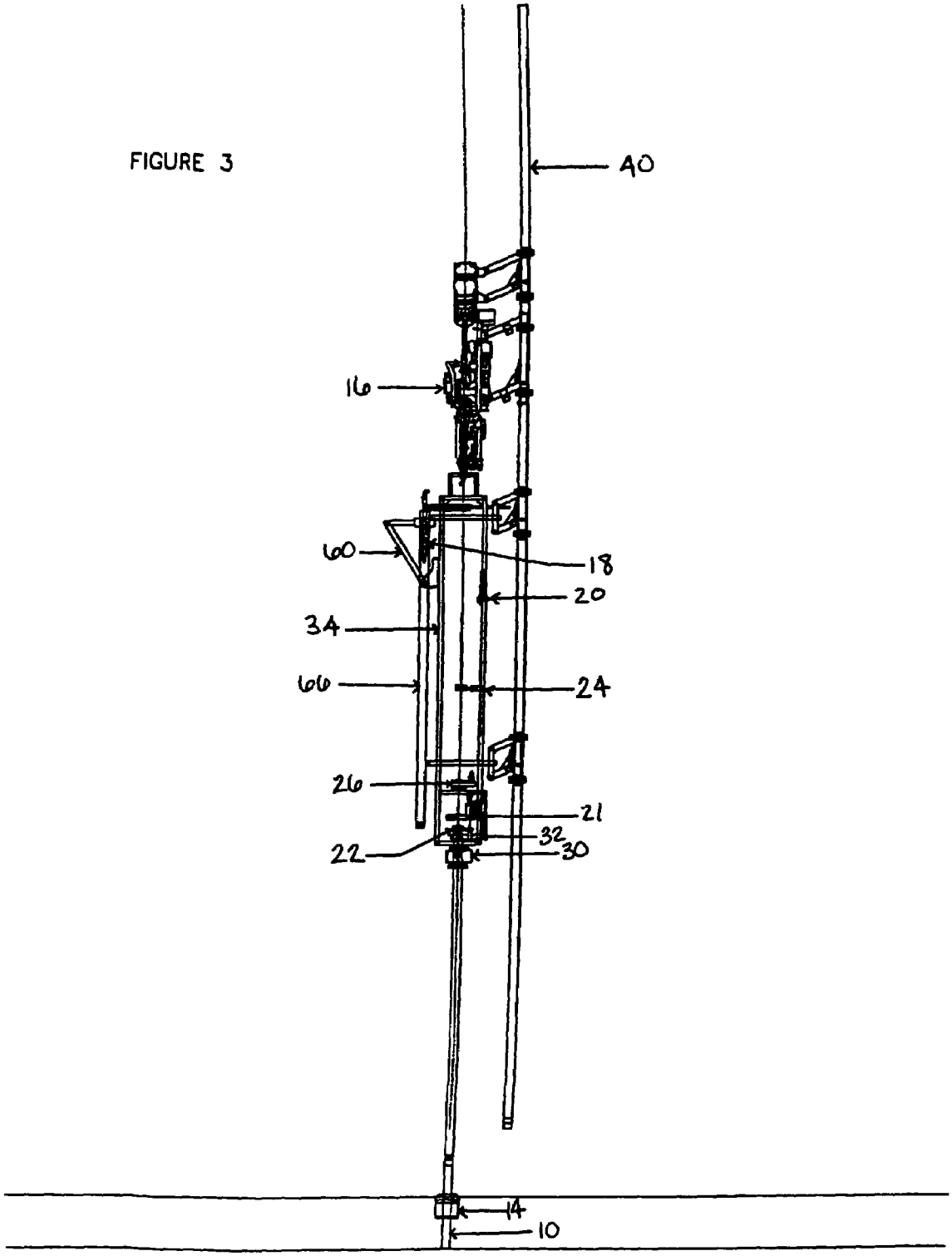
FIG. 3 is an elevated view of the system according to the invention, illustrating a fill up and a circulation tool inserted into the hoisted first joint of tubular.

In understanding the overall function and operation of the system, reference should be made to the drawings, FIGS. 1A, 1B, 1C and 2-5. As illustrated in FIGS. 1A, 1B and 1C, the string load has been transferred to the spider, the joint above the elevator has just been connected to the string, the mud tool has finished its filling operation, the elevator has opened its slips, the stabber has opened, the guide has opened, the tong jaws are retracted, the backup opened, and the manipulator arm has gripped the next joint to be installed. As the frame is lifted, the stabber is pivoted up and the mud tool gets extracted from the string. As the mud tool clears the end of the string it is positioned outboard of the frame in a path directly in line with the upward moving joint held by manipulator arm, which is shown in FIG. 2. In FIG. 3, the frame is positioned such that the end of the string is located where the stabbing guide can be installed properly. Also, the joint is ready to be located inside the frame with the mud tool installed. In FIG. 4, the slips on the elevator are set and the joint moved inside the frame. The stabbing guide, guide, and stabber are closed around the pipe. The driller will move the frame upward slightly, shown in FIG. 5, and release the slips in the spider. At the same time, the manipulator arm will lower the joint into the stabbing guide and the end of the string. Next the stabbing guide will open, the maniuplator arm will release, the backup will close, and the spinner will grip and turn the pipe. As the driller lowers the string, the spinner will stop and release, the manipulator arm will lower, the mud tool will activate, and the tong will finish the makeup. The process can now be repeated to attach the next joint.

In short, the invention contemplates that the joint of tubular being added to the string of tubulars will be aligned with the string, and will be stabbed, threaded and torqued into the string of tubulars while the string is being lowered into and/or towards the wellbore. With this process, by the time the elevator reaches the rig floor, or is in proximity to the floor, all of the contemplated operations will have been completed and the system will begin again the sequence described herein. Moreover, to pull a tubular string from the well bore, the sequence is reversed.

What is claimed is:

1. A method for running a string of oilfield tubulars using a frame mounted in association with a structure of an oil derrick, each of said tubulars having an upper end and a lower end, wherein said tubulars are run into and/or toward an earth wellbore, comprising:

using a drawworks associated with said derrick to move said frame for lowering said string of oilfield tubulars into and/or toward the wellbore; and threading at least one oilfield tubular joint into the upper end of said string of oilfield tubulars while said string of oilfield tubulars is being lowered into and/or toward the wellbore in association with the movement of said frame.

2. The method according to claim 1, wherein said oilfield tubular joint is aligned with the string of oilfield tubulars, and is stabbed, threaded and torqued into said string while said string is being lowered into and/or toward the wellbore.

3. The method according to claim 1, including in addition thereto, the step of lowering the tubular string into the wellbore through a spider, located at or near the rig floor and not associated with the frame.

4. The method according to claim 3, including in addition thereto, the step of closing the spider having slips to allow the spider to support the weight of the tubular string once an elevator having slips is opened.

5. The method according to claim 4, including in addition thereto, the step of opening the elevator slips, thereby transferring the weight of the tubular string to the spider.

6. The method according to claim 5, including in addition thereto, the step of elevating a second oilfield tubular joint above and aligned with said string of oilfield tubulars.

7. The method according to claim 6, wherein said second oilfield tubular joint is stabbed, threaded and torqued into said string while said string is being lowered into and/or toward the wellbore.

8. The method according to claim 1, wherein the step of threading further comprises the step of rotating the string of oilfield tubulars.

9. The method according to claim 8, wherein the step of rotating the string of oilfield tubulars comprises using a top drive.

10. The method according to claim 1, further comprising the step of moving the oilfield tubular joint into position for threading with the string of oilfield tubulars, wherein the oilfield tubular joint is gripped and moved by a mechanism associated with the frame.

11. A method for running a string of oilfield tubulars using a frame mounted in association with a structure of an oil derrick, each of said tubulars having an upper end and a lower end, wherein said tubulars are run into and/or toward an earth wellbore, comprising:

lowering the string of oilfield tubulars into and/or toward the wellbore; and threading at least one oilfield tubular joint into the upper end of said string of oilfield tubulars using a topdrive while said string of oilfield tubulars is being lowered into and/or toward the wellbore in association with the movement of said frame.

12. The method according to claim 11, wherein said plurality of made-up oilfield tubular joints are aligned with the string of oilfield tubulars, and are stabbed, threaded and torqued into said string while said string is being lowered into and/or toward the wellbore.

13. A system for running a string of oilfield tubulars into a wellbore, comprising:

a topdrive adapted to be lowered along a vertical line leading from a traveling block to the wellbore; and a frame connected to said topdrive, said frame being capable of being lowered along with said top drive and by using a drawworks and thus transporting a joint of oilfield tubular within said frame, and also transporting equipment for aligning said joint with said string of oilfield tubulars, and for stabbing, threading and torquing said joint of tubular to said string of oilfield tubular while said frame is being lowered along said vertical line.

14. The system according to claim 13, further comprising a spinner mounted with the frame, wherein the spinner is configured to grip the joint of oilfield tubular and rotate the joint of oilfield tubular for connection to the string of oilfield tubulars while the frame is being lowered.

15. A system for running a string of oilfield tubulars into a wellbore, comprising:

a traveling block adapted to be lowered along a vertical line leading to a wellbore;

an elevator in operative association with said traveling block; and a frame in association with said elevator, said frame being lowered along with the downward movement of said elevator, thus transporting a joint of oilfield tubular and also transporting equipment for aligning said joint with said string of oilfield tubulars, and for stabbing, threading and torquing said joint of tubular to said string of oilfield tubular while said frame is being lowered along said vertical line.

* * * * *